United States Patent [19]

Ostendorf

[11] Patent Number: 4,533,256

[45] Date of Patent: Aug. 6, 1985

[54] DIVE TIMER

[75] Inventor: Larry P. Ostendorf, McCordsville, Ind.

[73] Assignee: Divers Supply Co., Inc., Indianapolis, Ind.

[21] Appl. No.: 566,571

[22] Filed: Dec. 29, 1983

[51] Int. Cl.[3] ..... G04F 8/00

[52] U.S. Cl. ..... 368/111; 368/10; 368/295

[58] Field of Search ..... 368/10, 1, 111, 112, 368/89, 107

[56] References Cited

U.S. PATENT DOCUMENTS

| | | | |
|---|---|---|---|
| 3,992,949 | 11/1976 | Edmondson | 368/1 |
| 4,109,140 | 8/1978 | Etra | 368/1 |
| 4,188,825 | 2/1980 | Farrar . | |
| 4,352,168 | 9/1982 | Anderson | 368/10 |

*Primary Examiner*—Bernard Roskoski

*Attorney, Agent, or Firm*—Woodard, Weikart, Emhardt & Naughton

[57] ABSTRACT

A dive timer for divers which automatically begins measuring bottom time after detecting submergence below a predetermined depth and, upon resurfacing, automatically stores the measured bottom time in memory and begins measuring the surface time following the dive. The current bottom time and current surface time are alternatively displayed during their respective time intervals, and bottom times and surface times from previous dives may be recalled from memory for display. The apparatus incrementally numbers dives, and stores and displays a particular bottom time and surface time with the dive number associated therewith. Bottom times and surface times are recalled from memory in the reverse sequence to that in which they were measured. Additionally, circuitry is disclosed for measuring and displaying time of day and calendar information, and for operating the apparatus as a stop watch and an alarm.

31 Claims, 16 Drawing Figures

DIVE TIMER

BACKGROUND OF THE INVENTION

The invention relates to equipment for divers and particularly to pressure-activated timing equipment for use in diving.

It is well known that divers, such as helmet divers and scuba divers, absorb nitrogen into the bloodstream during a dive and that excessive accumulation of nitrogen in a diver's bloodstream causes decompression sickness, or "the bends". To help divers dive safely without risk of "the bends" numerous devices have been developed over the years to provide dive time information and assist the diver in calculating remaining safe bottom time.

An underwater diving instrument shown in in U.S. Pat. No. 3,696,610 to Charbonnier employs a manually operated analog stop watch to measure dive time. This apparatus further includes a display of time of day using a conventional set of three hands for display of hours, minutes and seconds. The Charbonnier device is capable of indicating only the currently measured dive time and is limited to displaying dive times not exceeding one hour. Furthermore, a diver using this apparatus could easily be confused in a critical situation by the cluster of dials and rotating hands on the face of the instrument.

An apparatus marketed by Princeton Techtronics of Heightstown, N.J. under the trademark "Bottom Timer" records the elapsed time that a diver is submerged below a predetermined depth. This device is a pressure-activated stop watch limited to indicating bottom time. It is entirely mechanical, and it must be manually reset before each dive.

U.S. Pat. No. 4,188,825 to Farrar discloses a monitor which simultaneously displays accumulated bottom time and surface time, automatically initiating a bottom time counter when a predetermined depth is reached and automatically preventing reset of the bottom time counter until a safe surface time has elapsed. This device is capable of displaying only current dive information. Each time the bottom time or surface time counters are reset, the formerly displayed information is lost.

The diver's control and indication apparatus shown in U.S. Pat. No. 4,109,140 to Etra detects the peak depth attained during a dive and uses that depth information to determine the maximum allowable time for the dive. Based on this data and on the time elapsing during the dive, the Etra apparatus determines and indicates the allowable time remaining. The apparatus also records surface time and uses that time, in conjunction with the peak depth and elapsed time of the previous dive, to determine an equivalent bottom time for reducing the diving time of a succeeding dive. Existing pressure sensors for use in an apparatus of this type are relatively large and expensive resulting in a costly, unwieldy apparatus for underwater use.

U.S. Pat. No. 4,005,282 to Jennings shows, in FIG. 6, a dive profile display device which records depth information during a dive and stores that information for later display on an external terminal. This device stores only depth information for a single dive and does not measure or store bottom time or surface time relating to the dive.

SUMMARY OF THE INVENTION

The present invention overcomes these and other disadvantages of the prior art by providing a dive timer for divers which automatically begins measuring bottom time after detecting submergence below a predetermined depth and, upon resurfacing, automatically stores the measured bottom time in memory. The apparatus includes means for recalling a stored bottom time from memory.

According to another aspect of the invention, bottom time and surface time are both measured and alternatively displayed, and both bottom times and surface times from previous dives are stored in memory.

Another aspect of the invention incorporates a technique for recalling data from memory for display in a predetermined sequence.

A further aspect of the invention is directed to a dive timer capable of measuring bottom time and time of day and alternatively displaying bottom time or time of day.

DESCRIPTION OF THE PREFERRED EMBODIMENT

Figure 1:
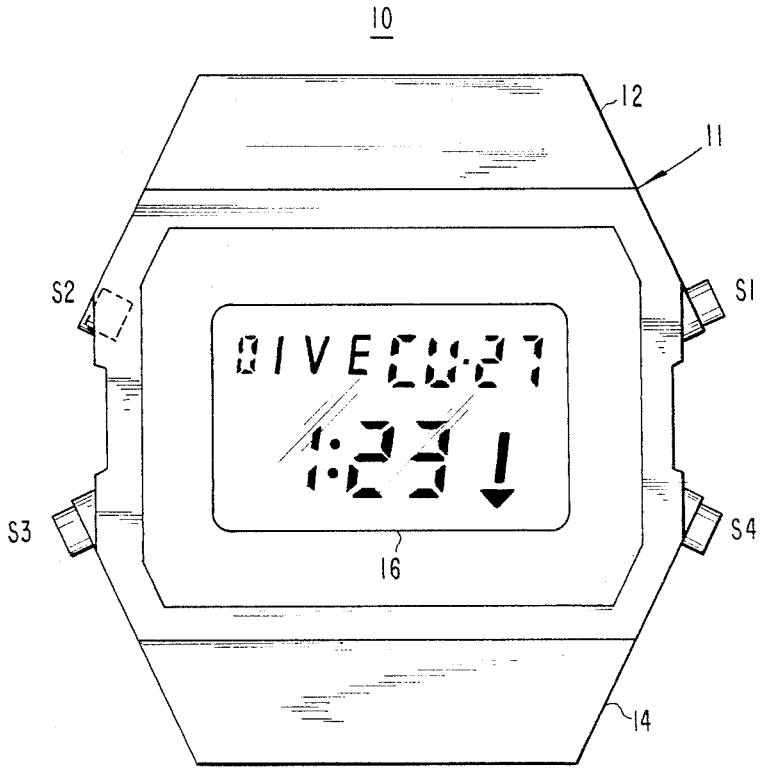
FIG. 1 is a top view of a case for a dive timer according to the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In the preferred embodiment, the dive timer according to the present invention is adapted to be mounted on a diver's wrist. Referring to FIG. 1, a dive timer 10 includes case 11 which has members 12 and 14 for connection to a wrist band of conventional design. Dive timer 10 further includes a display 16 which will be further described hereafter, as well as four control switches S1, S2, S3 and S4. For reasons which will be explained hereafter, S2 is a recessed switch.

Figure 2:
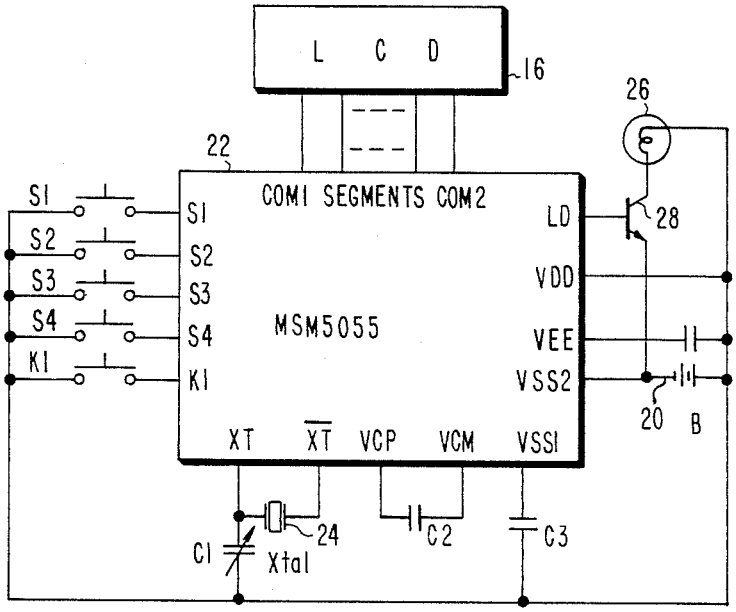
FIG. 2 is an schematic drawing of the preferred embodiment of a dive timer circuit according to the present invention.

Referring now to FIG. 2, the electrical schematic of the preferred embodiment of the dive timer circuit is illustrated. Switches S1–S4 are connected, as shown there, between the positive terminal of battery 20 and inputs S1–S4, respectively, of microprocessor 22. Microprocessor 22 is also connected to display 16, which is a liquid crystal display (LCD). Displays of this type are available from Seiko Instruments U.S.A., Inc., 2990 West Lomita Boulevard, Torrance, Cal. 90505. Battery 20 is connected between terminals VDD and VSS2 of microprocessor 22 and is a long-life lithium cell of 3 volts DC output voltage. Inputs S1–S4 collectively make up a 4-bit I/O port of microprocessor 22, which is a 4-bit microprocessor, type number MSM5055, commercially available from Oki Electric Industry Co., Ltd.; International Division; 10-3 Shibaura 4-chome; Minato-ku, Tokyo 108, Japan. The MSM5055 is a single-chip CMOS microcomputer including onboard ROM and RAM as well as direct display drive outputs COM1, COM2 and SEGMENTS shown in FIG. 2. The display drive outputs are connected to display 16 in a conventional manner to energize desired segments of the LCD display according to a desired output display. Microprocessor 22 operates at a clock frequency of 32.768 KHz as determined by crystal 24. Capacitor C1 is provided as a trim capacitor for fine adjustment of the clock oscillator frequency.

Lamp 26 is provided to provide back lighting for LCD display 16 in low underwater light level or nighttime conditions. Lamp 26 is operated under control of the LD output of microprocessor 22. When the LD output goes high, transistor 28 turns on and current flows from the positive terminal of battery 20 through lamp 26 and transistor 28 and on to the negative terminal of battery 20. Output LD is caused to go high by microprocessor 22 in certain modes under control of switch S4, as will be described.

Switch K1 is a diaphragm switch included to detect submergence below a predetermined depth. Switch K1 is set to respond to a pressure corresponding to a depth of approximately 5–10 feet to signal the onset and termination of a dive.

Figure 3:
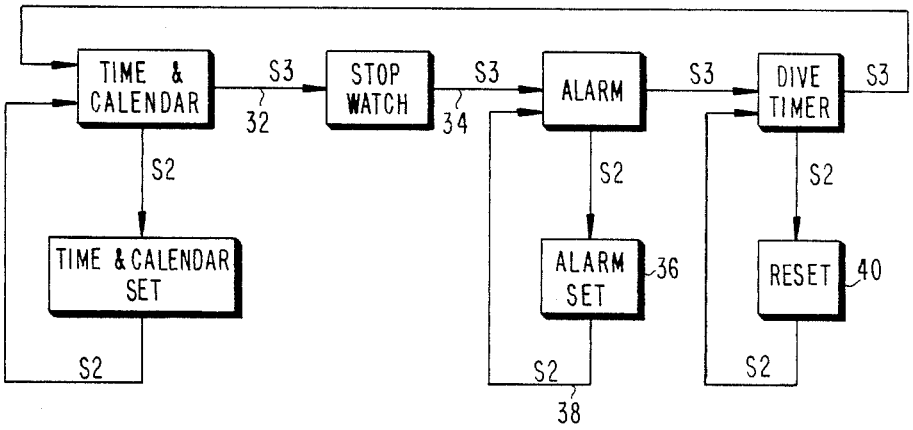
FIG. 3 is an overall state diagram illustrating the sequencing between the principal modes of operation of the dive timer.

The operation of the dive timer circuit shown in FIG. 2 may be further understood with reference to the state diagrams of FIGS. 3 and 4. Referring first to FIG. 3, the overall state diagram for the dive timer includes four principal logic states, or modes: TIME & CALENDAR, STOPWATCH, ALARM, & DIVE TIMER. Switch S3 is used to change the dive timer from one mode to another in a manner which will now be described. When the dive timer is in any principal mode, actuation of switch S3 causes a transition to the next principal mode. For example, if the dive timer is in TIME & CALENDAR mode, actuation of switch S3 causes the dive timer to proceed to STOPWATCH mode as indicated by the term S3 on line 32. Continuing with this example, if switch S3 is again actuated, the mode changes again, from STOPWATCH to ALARM mode as indicated by the term S3 on line 34.

In the same manner as that just described, if switch S2 is actuated when the dive timer is in the ALARM mode, the dive timer switches from ALARM mode to ALARM SET mode, represented by logic state 36. When the dive timer is in the ALARM SET mode, switch S3 no longer can effect a state transition. The response of the dive timer circuit is changed, as will be described later with reference to the ALARM SET mode. While in the ALARM SET mode, as seen in FIG. 3, actuation of switch S2 causes the dive timer to revert to ALARM mode along line 38. In the same manner, when the dive timer is in DIVE TIMER mode, actuation of switch S2 causes the mode to change to RESET mode, logic state 40, and thereby alter the response of the dive timer to subsequent actuations of switch S3. The relationship between TIME & CALENDAR mode and the TIME SET mode is identical to the relationship just described between DIVE TIMER mode and RESET mode.

Figure 4A:
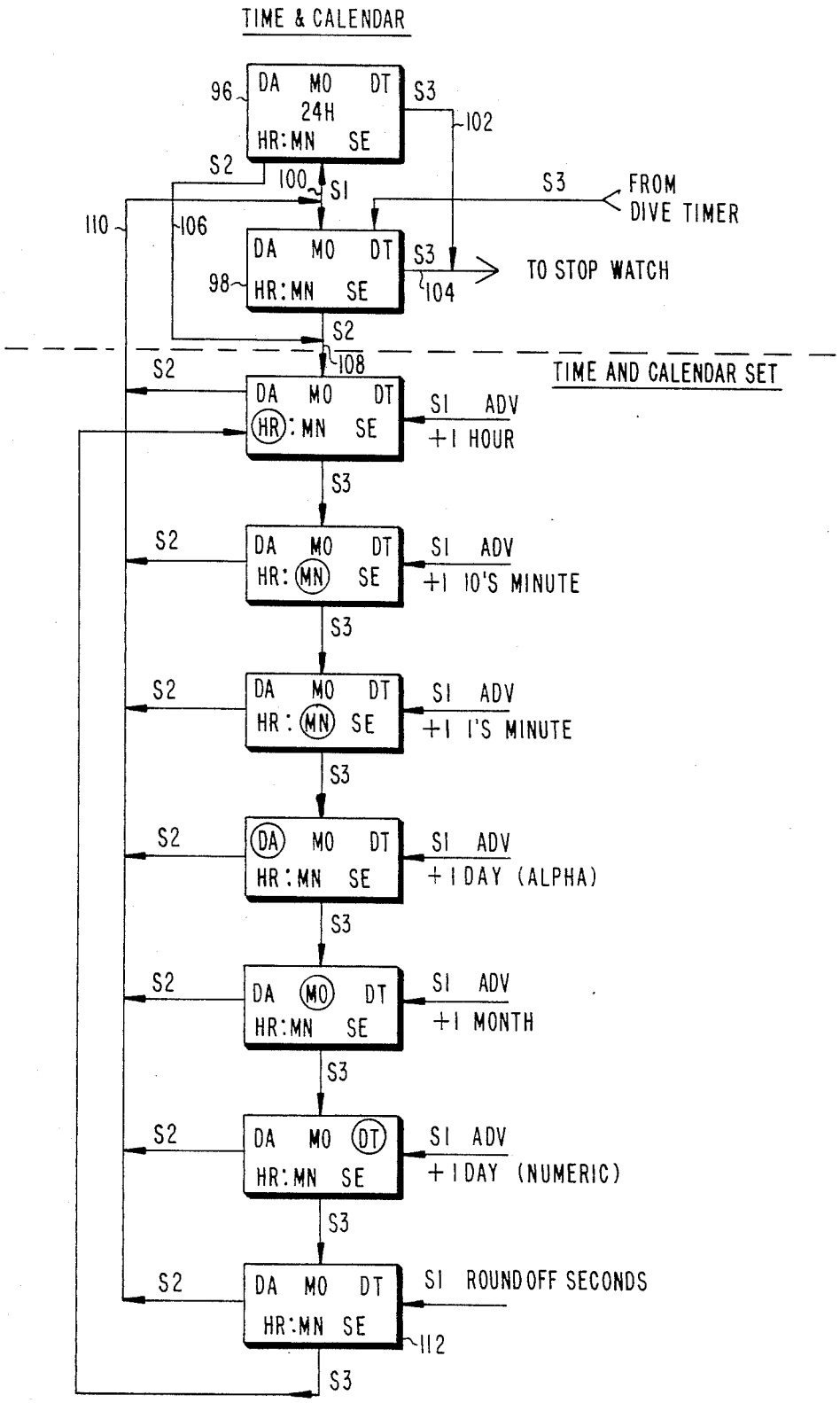
FIGS. 4A–4D are detail state diagrams illustrating the sequencing between modes of operation of the dive timer.
Figure 4B:
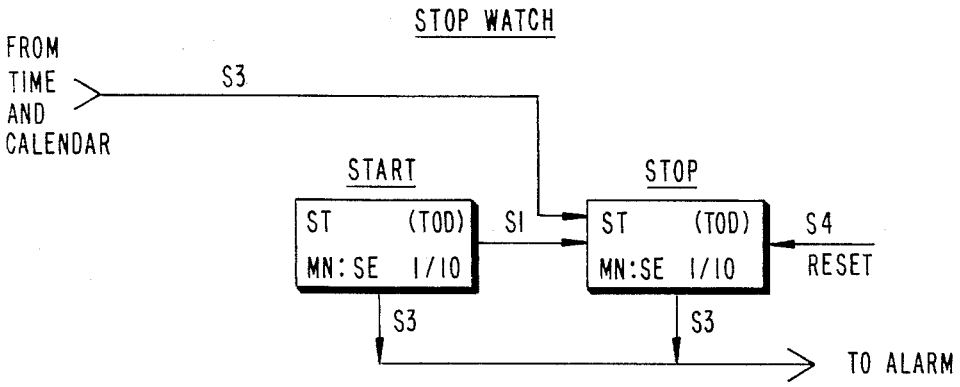
Figure 4C:
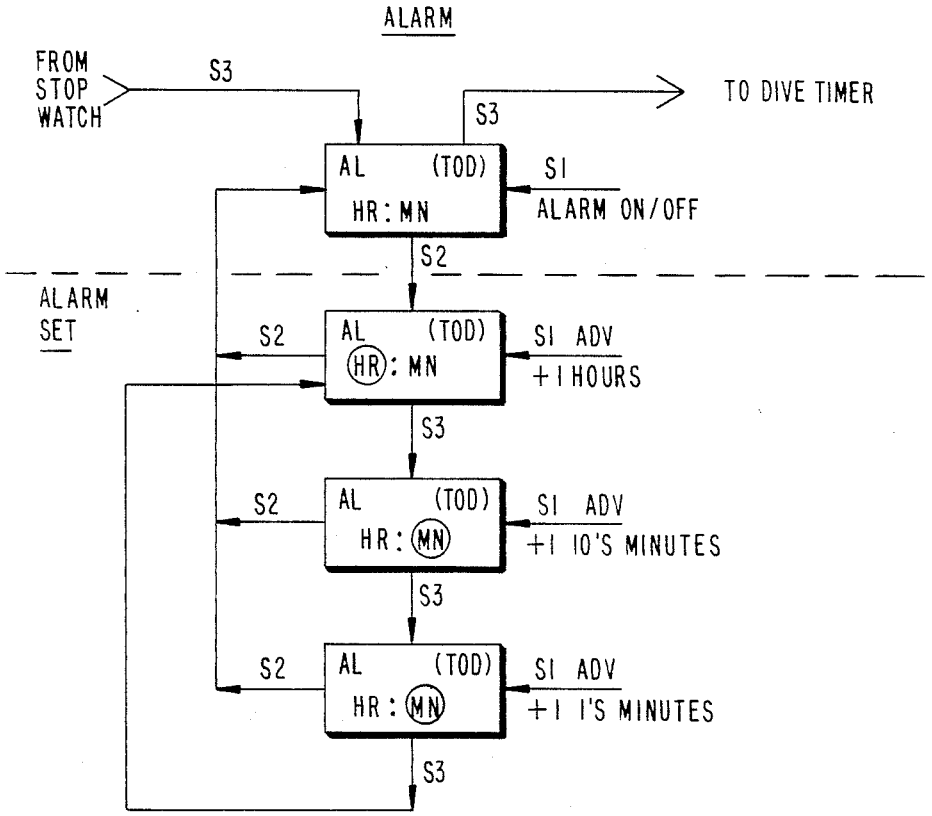
Figure 4D:
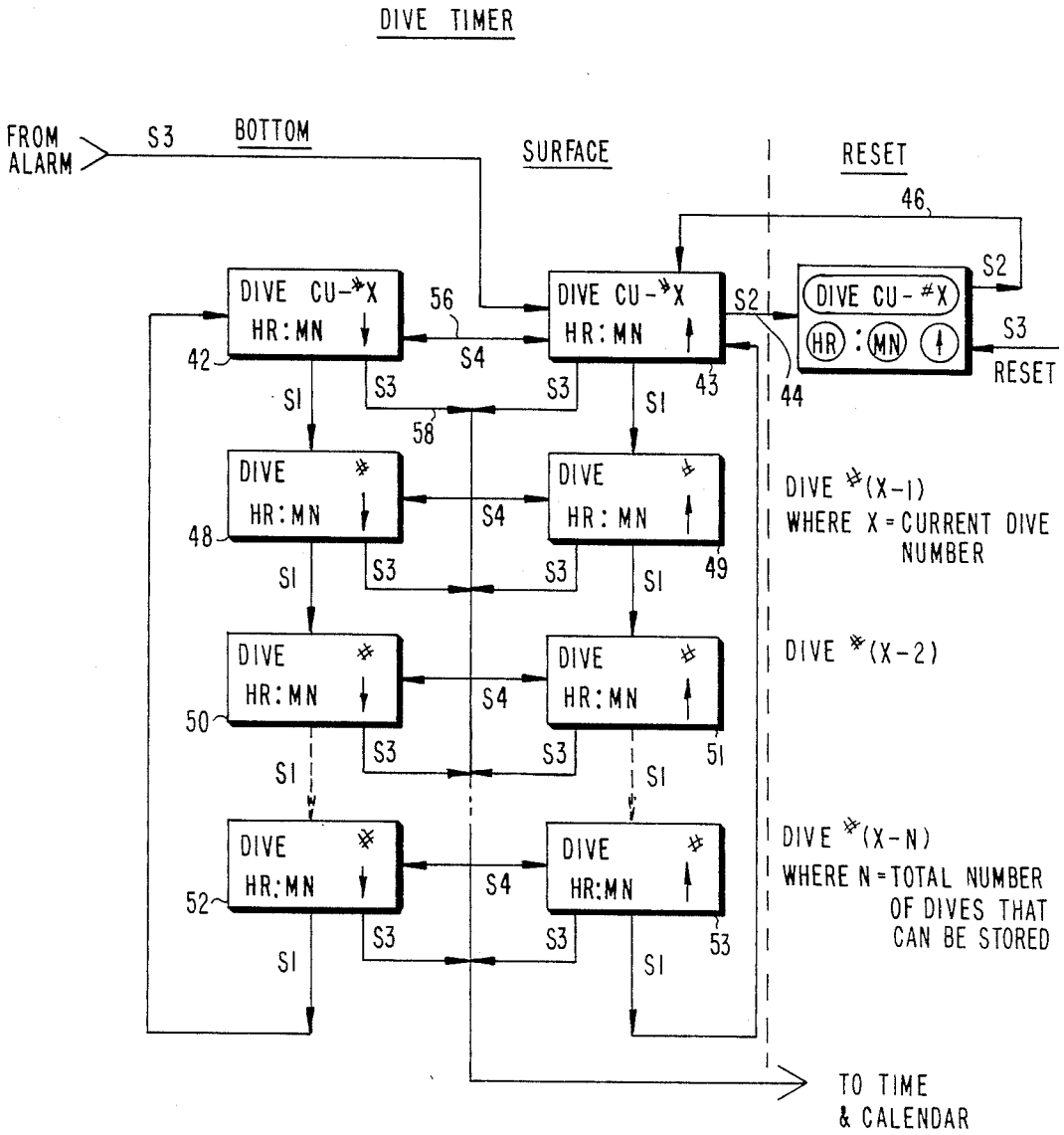

Referring now to FIG. 4D, the operation of the dive timer circuit in DIVE TIMER mode and RESET mode will be described in further detail. One way of entering DIVE TIMER mode is, as just described, to actuate switch S3 while in ALARM mode. The principal method for entering DIVE TIMER mode is upon actuation of diaphragm switch K1. Any closure of diaphragm switch K1 activates DIVE TIMER mode and causes microprocessor 22 to begin measuring bottom time and displaying that time in display 16 as current bottom time. The dive timer is then operating in the logic state corresponding to current bottom time, logic state 42. Further, when diaphragm switch K1 is closed, logic state 42 functions as a default logic state for the circuit. That is, the circuit will remain in any other logic state for only 5 seconds with switch K1 closed and will then revert back to logic state 42 and display the current bottom time.

DIVE TIMER mode and RESET mode are separated by a dashed line in FIG. 4D through which passes lines 44 and 46 representing, respectively, the changeover from DIVE TIMER mode to RESET mode and the return to DIVE TIMER mode.

Figure 5A:
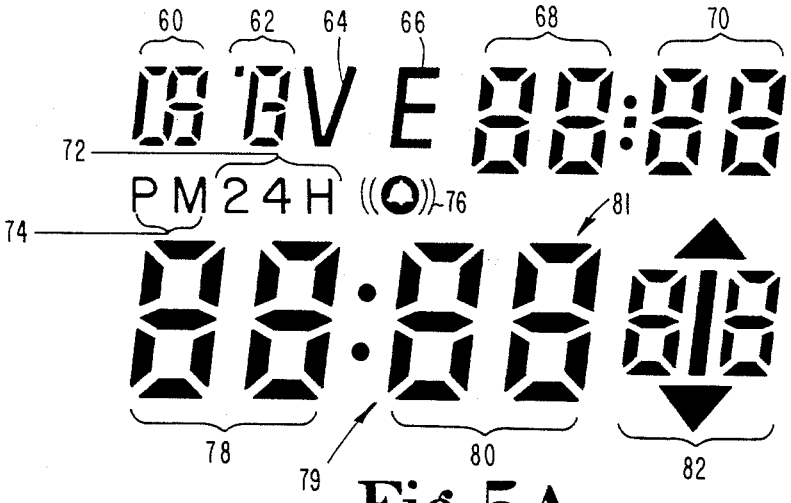
FIGS. 5A–5G are drawings illustrating examples of displays corresponding to various modes of operation of the dive timer.
Figure 5B:
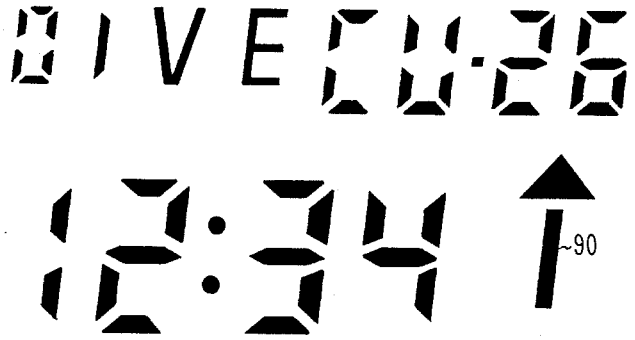
Figure 5C:
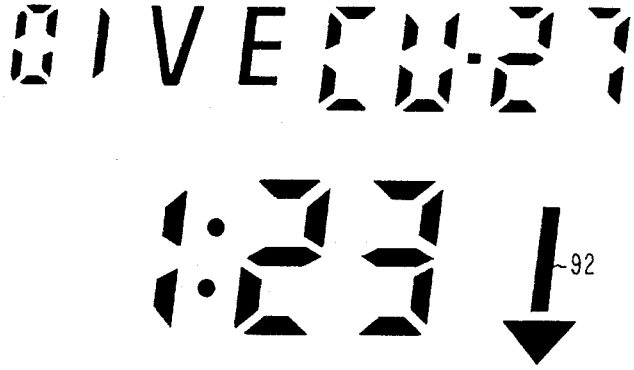

The significance of the terms within the various blocks in FIG. 4D may be further understood with reference to FIGS. 5A and 5B. FIG. 5A shows all the pixels of display 16 which can be illuminated. FIG. 5B shows the display segments which are illuminated during DIVE TIMER mode in surface time logic state 43. Particular pixels in segments 60 and 62, and segments 64 and 66 of the display are illuminated to cause a display representative of the word DIVE to appear in the upper left corner of the display shown in FIG. 5B. Immediately adjacent thereto segment 68 is illuminated to form the letters CU, and segment 70 is illuminated to display a two-digit number representative of the current dive number. The upward-pointing arrow 90, formed by illumination of two of the pixels in segment 82, indicates that the dive timer is in one of the surface time logic states, and the corresponding surface time is indicated in the hour (HR) and minutes (MN) segment portions of the display. In the exemplary display shown in FIG. 5B, 12 hours and 34 minutes of surface time have elapsed in dive #26, 26 being the number of the current dive. Similarly, in FIG. 5C, a down-pointing arrow 92 indicates a display of bottom time. In this exemplary display, the dive timer is in the DIVE TIMER mode showing dive #27, which is the current dive number as indicated by the letters CU. The diver has been underwater for one hour and 23 minutes. If a previous bottom time were indicated in the display instead of the current bottom time, the segment portion corresponding to the letters CU would not be illuminated but the dive number would remain in its corresponding segment portion.

Previous bottom times and surface times made be recalled from memory and displayed using switch S1. Logic states 42 and 43 represent, respectively, the logic states corresponding to the current dive, which is indicated as #X, where X equals the current dive number, a number which is generated by microprocessor 22. Similarly, logic states 48 and 49 correspond to dive #(X-1), the dive immediately preceding the current dive. The next preceding dive corresponds to logic states 50 and 51, and so on, with the Nth preceding dive represented by logic states 52 and 53, where N equals the total number of dives that can be stored in memory. It will be understood that N+1 logic states exist for both bottom time and surface time. Preferably sufficient memory is allotted to allow storage of at least four previous dives, although the particular number of dives capable of being stored does not in any way limit the scope of the present invention.

The technique for recalling previous dive times from memory will now be described. As shown in the left half of FIG. 4D, successive actuations of switch S1 cause the dive timer to sequence backward through all the logic states corresponding to bottom time and to adjust the display 16 accordingly, in the order 42, 48, 50, 52 and then back to 42. The current and the N stored bottom times may thus be viewed in sequence by a diver desiring to determine allowable bottom time for a succeeding dive or to record dive times in a logbook at some convenient time after a number of dives, such as after a two-tank boat dive. Similarly, any actuation of switch S1 while the dive timer is in any of the logic states corresponding to surface time causes the dive timer to sequence through the logic states in the loop comprised of logic states 43, 49, 51 and 53.

In addition to sequentially accessing the stored record of dive times for either bottom time or surface time, the dive timer switches between bottom time mode and surface time mode for any particular dive number by successive actuations of switch S4, as depicted by two-way lines 56 bearing indication S4.

As has been described, actuation of switch S3 when the dive timer is in DIVE TIMER mode causes a mode change to TIME & CALENDAR mode. This is indicated by lines 58 bearing the indication S3. That is, regardless of the dive number which is currently displayed, the dive timer switches to TIME & CALENDAR mode when switch S3 is actuated.

However, the function of switch S3 is changed by a mode change to RESET mode in a manner which will now be described. If the current mode is current surface time, a closure of switch S2 changes the dive timer to RESET mode as indicated by line 44. In RESET mode, switch S3 performs a reset function, causing a reset of the current dive number to 1 and causing the memory to be cleared. Because the diver's dive record stored in memory is completely erased when switch S3 is closed during RESET mode, the dive timer provides a number of security features. Switch S2 is rendered inactive when diaphragm switch K1 is closed. This makes it impossible for a diver to enter either SET mode or RESET mode while diving. Thus, there is no risk that a diver in a confused state of mind could inadvertently reset the dive timer memory in a critical underwater situation. Further, switch S2 is recessed as a precaution to minimize the risk that a diver will inadvertently enter the RESET mode on the surface and erase the dive record stored in memory. As an additional precaution, microprocessor 22 causes the entire display to blink when the dive timer is in RESET mode. The blinking of the display is indicated in FIG. 4D by circles around the three segment portions in the bottom of the display and the closed path around the upper segment portions. The blinking display alerts a diver to the operation in RESET mode and the consequent possibility of clearing the memory. Actuation of switch S2 in RESET mode causes a change of state from RESET mode to DIVE TIMER mode and a return to logic state 43 wherein the current surface time is displayed in display 16.

The system as just described includes a manual reset, which has been found to satisfy the needs of most divers. In an alternative embodiment, the dive timer is automatically reset after a period of approximately 90 hours of measured surface time, recognizing that after surface time of such duration, a diver is free of accumulated nitrogen.

The operation of the dive timer in the DIVE TIMER mode may be summarized as described in the following table:

| Switch | Operation |
|---|---|
| S1 | recall stored dives from memory in reverse order |
| S2 | bottom time mode: no function;<br>current surface time mode: change to RESET mode |
| S3 | DIVE TIMER mode: move to TIME & CALENDAR mode;<br>RESET mode: clear memory and reset dive number to 1 |
| S4 | switch between bottom time and surface time modes |

Referring now to FIG. 4A, the operation of the dive timer in TIME & CALENDAR mode will be described. Logic states 96 and 98 represent, respectively, the operational states corresponding to 24-hour display and 12-hour display. Transition between these two logic states is effected by actuation of switch S1 as indicated by line 100. As shown by lines 102 and 104, switch S3 causes a transition from either of these two logic states to STOPWATCH mode. Actuation of switch S3 during DIVE TIMER mode causes a transition from DIVE TIMER mode to TIME & CALENDAR mode as already described, and particularly to logic state 98 in which the time and date are displayed in a 12-hour format. Display segments 60 and 62 (FIG. 5A) are used in TIME & CALENDAR mode to indicate the day (DA) in a 2-digit representation of the day, according to the following format:

| Day | Alphabetic Display |
|---|---|
| Sunday | SU |
| Monday | MO |
| Tuesday | TU |
| Wednesday | WE |
| Thursday | TH |
| Friday | FR |
| Saturday | SA |

Display segment 68 is used to indicate the month (MO), and display segment 70 is used to indicate the day of the month (DT). Time is indicated in hours (HR), minutes (MN) and seconds (SE) by means of display segments 78, 80 and 82, respectively. Display segment 72 (24H) is lit if the dive timer is in 24-hour mode, and display segment 74 (PM) is lit during 12-hour mode to indicate hours after noon.

Figure 5D:
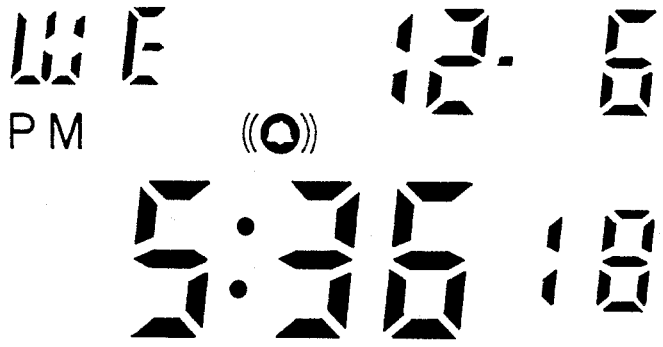
Figure 5E:
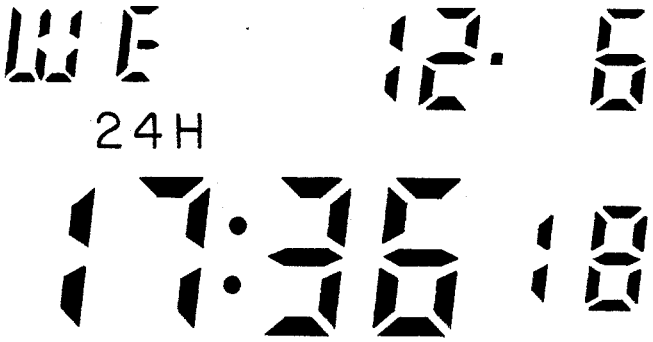

FIGS. 5D and 5E depict examples of dive timer operation in the TIME & CALENDAR mode. In FIG. 5D, the display indicates 5:36:18 PM on Wednesday, December 6. Illumination of display segment 76 indicates that the alarm is set. FIG. 5E shows the same time and day as FIG. 5D, with the time displayed in the 24-hour format and with the alarm not set.

With continuing reference to FIG. 4A, the TIME & CALENDAR SET mode will now be described. In order to enter this mode, as has been described, switch S2 must be actuated from the TIME & CALENDAR mode. As indicated by lines 106 and 108, this transition occurs regardless of whether the dive timer is in 12-hour or 24-hour mode. However, microprocessor 22 keeps track of the mode from which this transition occurs and uses this information to effect a return to the same location upon actuation of switch S2 in the TIME & CALENDAR SET mode. This is indicated by the termination of transition line 110 into line 100. Once TIME & CALENDAR SET mode has been entered, switch S3 selects the parameter to be set and switch S1 increments the selected parameter. For example, upon first entering TIME & CALENDAR SET mode, display segment 78 begins to flash indicating that the dive timer is ready to set the hours. At this time, microprocessor 22 causes the hours display to advance by one hour for each closure of switch S1. Actuation of switch S3 will cause a transition to the next logic state, corresponding to tens of minutes. In this logic state, display segment 79 is adjusted independent of display segment 81 by actuation of switch S1. Similarly, units of minutes, day of the week, month and day of the month are adjusted, respectively, in the next four logic states. Seconds are adjusted in logic state 112, wherein closure of switch S1 rounds off the seconds count to the nearest minute. The minutes display is incremented by one minute if a seconds count equal to or greater than 30 is rounded off. By operating switch S1 in this mode, the time of day can be synchronized to a known time standard within one second. It will be noted that in the TIME & CALENDAR SET mode, switch S3 is effective only to cause transitions between the various logic states within that mode and cannot be used to change to STOPWATCH mode.

Figure 5F:
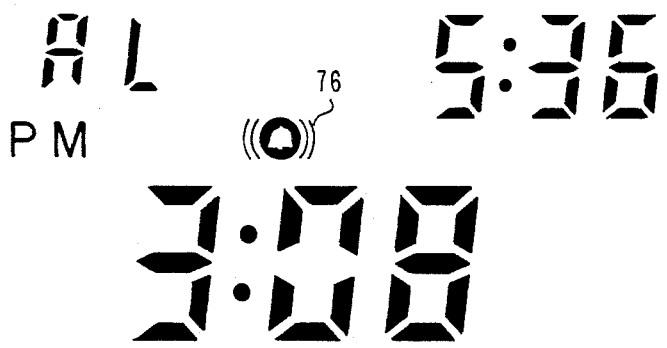
Figure 5G:
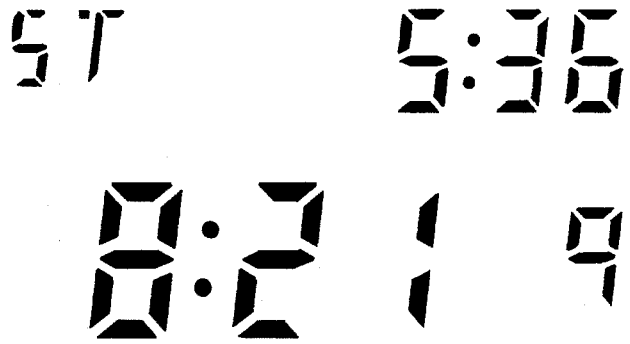

If, however, the dive timer is currently in TIME & CALENDAR mode, switch S3 is effective to cause a transition to STOPWATCH mode, as illustrated in FIG. 4B. Particularly, S3 causes a transition to the stop logic state in the STOPWATCH mode. In STOPWATCH mode, display segments 60 and 62 are illuminated to display ST as shown in FIG. 5G, indicating operation in STOPWATCH mode. The time of day (TOD) is shifted at this time to segments 68 and 70, and only hours and minutes are displayed there. At this time the outputs from microprocessor 22 to display 16 include minutes, seconds and tenths (1/10) of seconds applied respectively to display segments 78, 80 and 82. Operation of the dive timer as a stopwatch consists of starting the timer with switch S1, stopping the timer with the same switch, and resetting the timer and light with switch S4. Also, as indicated, actuation of switch S3 from either the start or stop logic states causes a transition to ALARM mode.

FIG. 5G depicts an example of dive timer operation in the STOPWATCH mode. The characters ST indicate STOPWATCH mode, as indicated above, and the main portion of the display indicates an elapsed time of 8 minutes and 21.9 seconds. The time of day is 5:36.

STOPWATCH mode operation is summarized in the following table:

| Switch | Operation |
|---|---|
| S1 | start and stop the timer |
| S2 | no function |
| S3 | change to ALARM mode |
| S4 | reset the timer and light |

Referring to FIG. 4C, the detailed operation of the dive timer in ALARM mode is illustrated. In this mode, display segments 60 and 62 are illuminated to display the characters AL to indicate the ALARM mode. As for the STOPWATCH mode, the hours and minutes of the time of day are shifted to the display segments 68 and 70. At this time, display segments 78 and 80 are used to display the currently set alarm time. Hours and minutes are displayed, and display segment 74 (PM) is illuminated if the currently set alarm time is after noon. This display format is illustrated by example in FIG. 5F wherein the time of day is 5:36 and the alarm is set for 3:08 PM. Illumination of display segment 76 indicates that the alarm is on.

Returning to FIG. 4C, switch S1 turns the alarm on and off in the ALARM mode. In ALARM SET mode, switch S1 operates in much the same manner as it does in TIME & CALENDAR SET mode. That is, it causes a time parameter selected by switch S3 to advance on each closure of the switch. As indicated in FIG. 4C, hours, tens of minutes and units of minutes are independently adjustable. Microprocessor 22 returns to the alarm mode after setting any of the variable alarm parameters if switch S2 is actuated. Switch S4 actuates lamp 26 through microprocessor 22. Once switch S4 is actuated in this mode, microprocessor 22 outputs a high signal on its LD output (FIG. 2). The operations just described may be summarized as follows:

| Switch | Operation |
|---|---|
| S1 | ALARM mode: turn alarm on or off;<br>ALARM SET mode: advance blinking digit |
| S2 | switch between ALARM and ALARM SET modes |
| S3 | ALARM SET mode: select digit to be advanced;<br>ALARM mode: switch to DIVE TIMER mode |
| S4 | operate light |

Figure 6:
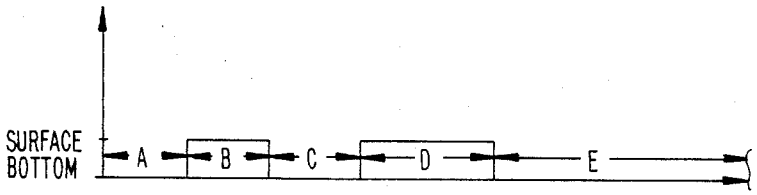
FIG. 6 is a timing diagram illustrating the relationship between surface time and the effective bottom time for a subsequent dive.

FIG. 6 is a timing diagram illustrating the relationship between surface time and subsequent bottom time. The bottom time for the first diver is indicated by the letter A, and that dive is numbered dive #1 by the dive timer. The time interval B represents the surface time following dive #1, and this time is stored in memory as surface time for dive #1. However, since the surface time B is less than 10 minutes, counting of bottom time resumes with the time A. Thus, upon resurfacing after the second dive of duration C, the bottom time indicated is equal to A+C and the indicated dive number is dive #1 in accordance with navy dive tables which consider the diver to be on the same dive if the surface time is less than 10 minutes. The next subsequent surface time, designated by the character D, is greater than 10 minutes. This number is stored in memory as the surface time for dive #1 in place of the previously stored dive #1 surface time, and the bottom time for the next subsequent diver, denominated dive #2, begins from zero. Microprocessor 22 increments the dive number from 1–99 and then rolls over to dive #1. Dives are accumulated and erased on a first-in, first-out (FIFO) basis. That is, after completion of N+1 dives the first dive is erased from memory and the last N dives are retained therein. If the measured surface time reaches 99 hours, the dive timer ceases timing surface time and maintains 99 as the surface time display. A further feature of the preferred embodiment of the present invention includes erasure of the bottom time if the bottom time is less than 10 seconds in duration, a time which is substantially less than the minimum time required for nitrogen accumulation in the blood stream.

Figure 7:
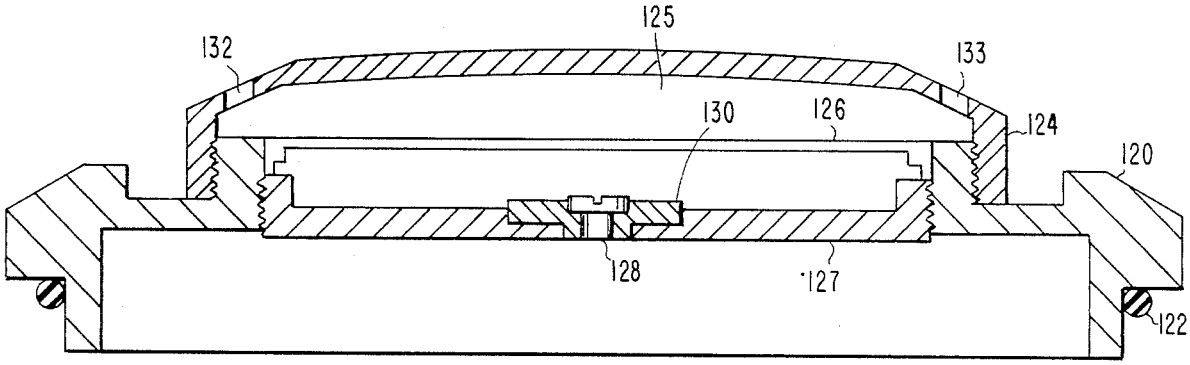
FIG. 7 is a cross-sectional side view of the rear portion of a case for a dive timer according to the present invention, particularly illustrating the diaphragm switch arrangement.

With reference now to FIG. 7, a cross-sectional view of the back of the dive timer case is provided. Back cover 120 is fastened to case 11 and sealed thereto by means of O-ring 122. A second cover 124 is threadedly fastened to back cover 120 to define a chamber 125 therebetween into which water can pass through holes 132 and 133. Back cover 122 includes a conductive rubber diaphragm 126 which is protected from outside objects by cover 124, which is a rigid cover, while remaining sensitive to ambient water pressure by means of holes 132 and 133. Diaphragm 126 flexes and moves inwardly toward member 127 in response to an increase in pressure. Member 127 is threadedly fastened to back cover 120 as shown in FIG. 7, and is provided at its center with a conductive terminal post 128 mounted within insulator 130 which is in turn mounted within member 127. Conductive diaphragm 126 and terminal post 128 together comprise the contacts of switch K1, the diaphragm switch previously described. Back cover 120 is electrically connected to the positive terminal of battery 20 while the conductive terminal post 128 is wired to the K1 input of microprocessor 122. Alternatively, back cover 120 may be wired to the K1 input and terminal post 128 to the battery positive terminal.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A dive timer for divers, comprising:

(a) means for detecting submergence of said dive timer at a predetermined dive depth;

(b) programmed measuring means coupled to said detecting means for measuring bottom time, said programmed measuring means including electronic memory means for storing measured bottom time, said programmed measuring means being operative to store a first measured bottom time from a first dive in said memory means while measuring a second bottom time from a second dive;

(c) display means for providing a display of bottom time; and (d) programmed circuit means for recalling said first bottom time from said memory means and supplying said first bottom time to said display means after said second diver is initiated.

2. The dive timer of claim 1 further comprising:

(f) means for incrementally numbering dives;

in which said display means is operable to display a bottom time with the dive number associated therewith.

3. The dive timer of claim 1 in which said memory means includes means for storing a plurality of bottom times and in which said circuit means includes means for recalling bottom times from said memory means in a predetermined sequence.

4. The dive timer of claim 3 further comprising:

(g) means coupled to said detecting means for measuring surface time;

in which said memory means further includes means for storing a plurality of surface times; said display means is further operable to display a surface time with the dive number associated therewith; and in which said circuit means further includes means for recalling surface times from said memory means in a predetermined sequence.

5. The dive timer of claim 4 in which said display means is operable to alternatively display bottom time and surface time.

6. The dive timer of claim 5 further comprising:

(h) means for measuring and displaying time of day.

7. The dive timer of claim 6 further comprising:

(i) means operable during a reset mode for clearing stored bottom and surface times from said memory means.

8. The dive timer of claim 4 further comprising:

(h) means for reassigning the last dive number to the current dive and including the bottom time from the last dive in the current bottom time if the current dive commences less than a predetermined minimum surface time after the last dive.

9. A dive timer for divers, comprising:

(a) means for detecting submergence of said dive timer at a predetermined dive depth;

(b) means coupled to said detecting means for measuring bottom time;

(c) means for measuring time of day;

(d) display means for alternatively displaying bottom time and time of day; and (e) control means coupled to said display means for controlling the parameter displayed;

(f) electronic memory means coupled to said measuring means for storing bottom times from a plurality of previous dives: and (g) Circuit means for recalling a stored bottom time from said memory means and supplying said stored bottom time to said display means.

10. The dive timer of claim 9 in which said control means includes means responsive to said detecting means for reverting to bottom time display after a predetermined time of displaying time of day.

11. The dive timer of claim 10 further comprising:

(h) means for incrementally numbering dives;

in which said display means is operable to display a bottom time with the dive number associated therewith.

12. The dive timer of claim 11 in which said circuit means includes means for recalling bottom times from said memory means in a predetermined sequence.

13. The dive timer of claim 12 further comprising:

(i) means coupled to said detecting means for measuring surface time;

in which said memory means further includes means for storing a plurality of surface times; said display means is further operable to display a surface time with the dive number associated therewith; and in which said circuit means further includes means for recalling surface times from said memory means in a predetermined sequence.

14. The dive timer of claim 13 in which said display means is operable to alternatively display bottom time and surface time.

15. The dive timer of claim 14 further comprising:

(j) means for reassigning the last dive number to the current dive and including the bottom time from the last dive in the current bottom time if the current dive commences less than a predetermined minimum surface time after the last dive.

16. A dive timer for divers, comprising:

(a) a diaphragm switch, said switch being operable to detect submergence of said dive timer at a predetermined dive depth;

(b) first programmed means coupled to said diaphragm switch for measuring the bottom time of a current dive;

(c) second programmed means coupled to said diaphragm switch for measuring surface time associated with the current dive;

(d) electronic memory means coupled to said first and second measuring means for storing a bottom time and surface time from a previous dive;

(e) display means operable during a first mode for alternatively providing a display of bottom time and surface time; and (f) programmed circuit means for alternatively recalling a stored bottom time and stored surface time from said memory means and alternatively supplying said stored bottom time and said stored surface time to said display means, said circuit means including means for recalling bottom times or surface times from said memory means in a predetermined sequence.

17. The dive timer of claim 16 further comprising:

(f) means for incrementally numbering dives;

in which said display means is operable to display a dive number with a bottom time or surface time associated therewith.

18. The dive timer of claim 17 further comprising:

(g) means for reassigning the last dive number to the current dive and including the bottom time from the last dive in the current bottom time if the current dive commences less than a predetermined minimum surface time after the last dive.

19. The dive timer of claim 18 further comprising:

(h) watch means operable in a second mode for measuring and displaying time of day;

(i) stop watch means operable in a third mode for measuring and displaying elapsed time, said stop watch means being manually actuable and resettable;

(j) alarm means operable in a fourth mode for signalling when a preset alarm time has been reached, said alarm means including means for setting the desired alarm time;

(k) control means coupled to said display means for controlling the parameter displayed, said control means including means responsive to said diaphragm switch for reverting to said first mode from said second, third or fourth modes after a predetermined time.

20. A method of monitoring dive time information with a dive timer carried by a diver comprising the steps:

(a) detecting submergence of said dive timer at a predetermined dive depth;

(b) measuring bottom time after said submergence is detected;

(c) storing a first bottom time from a first dive in an electronic memory and measuring a second bottom time from a second dive after said submergence is detected for a second time;

(d) displaying said first bottom time during said first dive and said second bottom time during said second dive; and (e) recalling said first bottom time from said memory and displaying said first bottom time after said second dive is initiated.

21. The method of claim 20 further comprising the step:

(f) incrementally numbering dives and displaying a bottom time with the dive number associated therewith.

22. The method of claim 21 further comprising the step:

(g) storing a plurality of bottom times in said memory, in which said recalling and displaying step includes recalling and displaying bottom times from said memory in a predetermined sequence.

23. The method of claim 22 further comprising the steps:

(h) measuring surface time;

(i) storing a plurality of surface times in said memory;

(j) displaying a surface time with the dive number associated therewith, in which said recalling and displaying step further includes recalling and displaying surface times from said memory in a predetermined sequence.

24. The method of claim 23 in which bottom time and surface time are alternatively displayed.

25. The method of claim 24 further comprising the step:

(k) measuring and displaying time of day.

26. The method of claim 25 further comprising the step:

(l) clearing stored bottom and surface times from said memory during a reset mode.

27. The method of claim 23 further comprising the step:

(k) reassigning the last dive number to the current dive and including the bottom time from the last dive in the current bottom time if the current dive commences less than a predetermined minimum surface time after the last dive.

28. The method of claim 25 further comprising the step:

(l) reverting to bottom time display after a predetermined time of displaying time of day.

29. A method of monitoring dive time information with a dive timer carried by a diver comprising the steps:

(a) detecting submergence of said dive timer at a predetermined dive depth with a diaphragm switch;

(b) measuring the bottom time of a current dive after said submergence is detected;

(c) measuring surface time associated with the current dive;

(d) storing a bottom time and surface time from a previous dive in an electronic memory;

(e) alternatively displaying bottom time and surface time; and (f) alternatively recalled a stored bottom time and stored surface time from said memory and alternatively displaying said stored bottom time and said stored surface time, in which said recalling and displaying step includes recalling and displaying bottom times or surface times from said memory in a predetermined sequence.

30. The method of claim 31 further comprising the step:

(g) incrementally numbering dives and displaying a dive number with a bottom time or surface time associated therewith.

31. The method of claim 30 further comprising the step:

(h) reassigning the last dive number to the current dive and including the bottom time from the last dive in the current bottom time if the current dive commences less than a predetermined minimum surface time after the last dive.

* * * * *

UNITED STATES PATENT AND TRADEMARK OFFICE

CERTIFICATE OF CORRECTION

PATENT NO. : 4,533,256

DATED : August 6, 1985

INVENTOR(S) : Larry P. Ostendorf

It is certified that error appears in the above-identified patent and that said Letters Patent is hereby corrected as shown below:

| | | |
|---|---|---|
| In claim 2, "(f)" | should be | --(e)-- |
| In claim 4, "(g)" | should be | --(e)-- |
| In claim 6, "(h)" | should be | --(f)-- |
| In claim 7, "(i)" | should be | --(g)-- |
| In claim 8, "(h)" | should be | --(f)-- |
| In claim 9(f), ":" | should be | --;-- |
| In claim 9(g), "Circuit" | should be | --circuit-- |
| In claim 17, "(f)" | should be | --(g)-- |
| In claim 18, "(g)" | should be | --(h)-- |
| In claim 19, "(h)" | should be | --(i)-- |
| "(i)" | should be | --(j)-- |
| "(j)" | should be | --(k)-- |
| "(k)" | should be | --(l)-- |

Signed and Sealed this

*Eighteenth* Day of *February 1986*

[SEAL]

*Attest:*

*Attesting Officer*

DONALD J. QUIGG

*Commissioner of Patents and Trademarks*